United States Patent [19]

Chrestensen

[11] 4,403,847

[45] Sep. 13, 1983

[54] ELECTROGRAPHIC TRANSFER APPARATUS

[75] Inventor: Gene L. Chrestensen, Rochester, N.Y.

[73] Assignee: Eastman Kodak Company, Rochester, N.Y.

[21] Appl. No.: 362,735

[22] Filed: Mar. 29, 1982

[51] Int. Cl.[3] ..... G03G 15/00

[52] U.S. Cl. ..... 355/3 TR; 355/3 SH; 355/14 TR; 118/651; 271/94; 271/196; 226/95

[58] Field of Search ..... 355/3 TR, 3 SH, 3 TE, 355/3 R, 3 DR, 14 TR, 14 SH; 118/621, 650, 651; 271/11, 90, 107, 109, 96, 94, 102, 103, 197, 196, DIG. 2; 226/95

[56] References Cited

U.S. PATENT DOCUMENTS

| | | | |
|---|---|---|---|
| 3,123,354 | 3/1964 | Ungerer | 271/197 |
| 3,132,050 | 5/1964 | Huber | 118/651 X |
| 3,425,610 | 2/1969 | Stewart | 226/95 |
| 3,452,982 | 7/1969 | Bischoff | 271/197 |
| 3,633,543 | 1/1972 | Pitasi et al. | 118/621 |
| 3,832,055 | 8/1974 | Hamaker | 355/3 R |
| 3,845,951 | 11/1974 | Hamaker | 271/243 |
| 4,110,027 | 8/1978 | Sato et al. | 355/3 TR |
| 4,179,215 | 12/1979 | Hage | 355/3 SH |
| 4,294,540 | 10/1981 | Thettu | 355/3 SH X |

*Primary Examiner*—A. C. Prescott

*Attorney, Agent, or Firm*—Lawrence P. Kessler

[57] ABSTRACT

Apparatus for electrostatically transferring a transferable image from an image-carrying member to a receiver member. The transfer apparatus includes a resilient, deformable electrically conductive member adapted to be connected to a source of electrical image transferring potential. The conductive member defines a passage connectible to a vacuum source for vacuum tacking a receiver member to a surface of such member. Such passage has a longitudinal axis which, at the surface of conductive member, defines an oblique angle to such surface. During image transfer, the conductive member deforms during pressure contact with the image-carrying member to eliminate the surface discontinuity at the passage opening so that an electrical transfer potential is uniformly applied to the receiver member.

6 Claims, 3 Drawing Figures

ELECTROGRAPHIC TRANSFER APPARATUS

BACKGROUND OF THE INVENTION

This invention relates generally to electrographic transfer apparatus, and more particularly to transfer roller apparatus for applying a uniform electrical transfer potential to a receiver member to effect transfer of a transferable image to such member.

In a typical electrographic process for making reproductions, an electrostatic charge pattern having an image-wise configuration corresponding to information to be reproduced, is formed on the surface of a grounded insulating member. The charge pattern is developed by applying developer material to such pattern to form a transferable image on the insulating member. The developer material includes for example, thermoplastic pigmented marking particles which are attracted to the charge pattern by electrostatic forces. The transferable image is transferred from the insulating member to a receiver member, and permanently fixed to such receiver member to form the reproduction. Transfer is accomplished by electrically charging the receiver member to a level sufficient to attract the developer material from the insulating member to the receiver member, while the receiver member is in contact with the area of the insulating member carrying the transferable image. Electrical charging of the receiver member is commonly effected by ion emission, for example from a corona charger, onto the surface of the receiver member, or by contacting the surface of the receiver member opposite the insulating member with an electrically biased transfer roller.

An electrically biased transfer roller is suitable for use in an electrographic process where multiple related images are transferred in superimposed relation on to a receiver member to form a composite reproduction, such as in making a multi-color reproduction. In such a process the receiver member is tacked to the transfer roller so that such member is successively returned into registered contact with the related transferable images on the insulating member. Examples of an electrically biased transfer roller are shown in U.S. Pat. No. 3,633,543, issued Jan. 11, 1972 in the name of Pitasi et al, and U.S. Pat. No. 3,832,055, issued Aug. 27, 1974 in the name of Hamaker. Such transfer rollers have hollow electrically conductive cores covered with electrically conductive, resilient, porous (foraminous) material. A partial vacuum effective within the cores tack the receiver members to the cover material, at least at the transfer nip formed with an image-carrying insulating member. However, the porosity of the cover material tends to create discontinuities in the electrical transfer field, which results in incomplete or non-uniform transfer.

SUMMARY OF THE INVENTION

This invention is directed to apparatus for electrostatically transferring a transferable image from an image-carrying member to a receiver member. The transfer apparatus includes a resilient, deformable electrically conductive member adapted to be connected to a source of electrical image transferring potential. The conductive member defines a passage connectible to a vacuum source for vacuum tacking a receiver member to a surface of such member. Such passage has a longitudinal axis which, at the surface of the conductive member, defines an oblique angle to such surface. During image transfer, the conductive member deforms during pressure contact with the image-carrying member to eliminate the surface discontinuity at the passage opening so that a electrical transfer potential is uniformly applied to the receiver member.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Referring to the accompanying drawings, a transfer roller apparatus 10 is illustrated for use in an electrographic process where reproductions are made by electrostatically attracting transferable images, carried by a moving member, from such member to a receiver member. For illustrative purposes, the transferable images comprise, for example, thermoplastic pigmented marking particles such as disclosed in U.S. Pat. No. 3,893,935, issued July 8, 1975 in the name of Jadwin et al; the image-carrying member is, for example, a grounded composite photoconductive web including an insulating layer, such as shown in U.S. Pat. No. 3,615,414 issued Oct. 26, 1971 in the name of Light; and the receiver member is a cut sheet of plain bond paper or transparency material. An exemplary electrographic process for forming the transferable images is shown in aforementioned U.S. Pat. No. 3,633,543.

Figure 1:
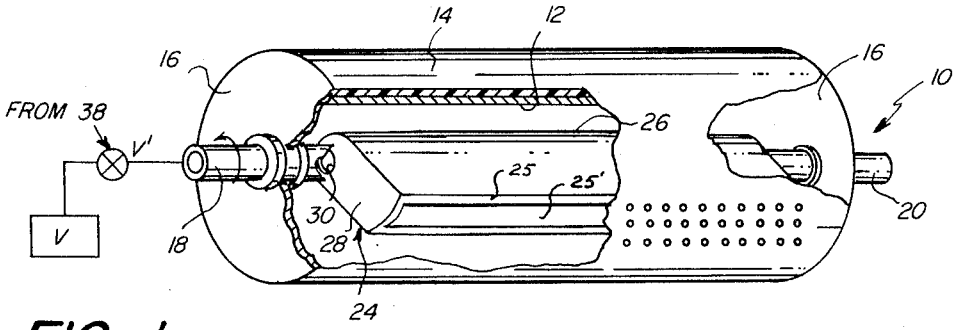
FIG. 1 is a view, in perspective, of the transfer roller apparatus according to this invention, with portions broken away or removed to facilitate viewing.
Figure 2:
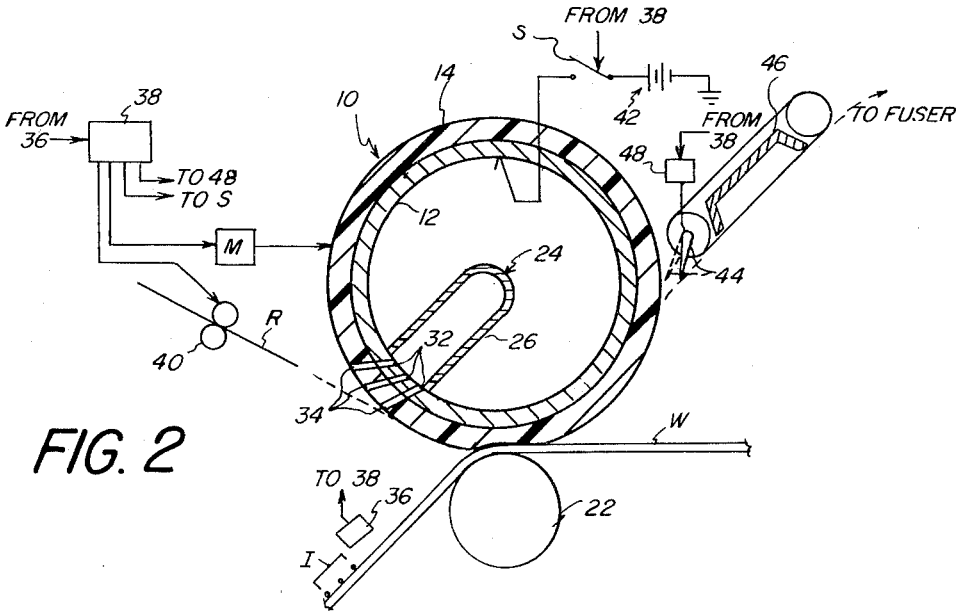
FIG. 2, is an end view, in cross-section, of the transfer roller apparatus of FIG. 1, showing its relation to an image-carrying member.
Figure 3:
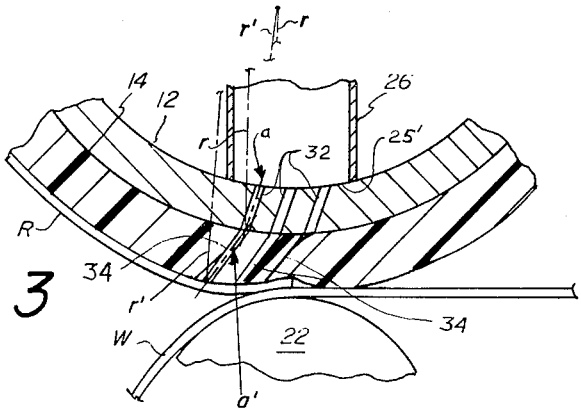
FIG. 3, is an end view, in cross-section and on an enlarged scale, of a portion of the transfer roller apparatus of FIG. 1, particularly showing the deformed portion.

The transfer roller apparatus 10 includes an electrically conductive cylindrical core 12, such as a hollow aluminum roller. A cover 14 of resilient, electrically conductive material, such as carbon impregnated rubber for example, is bonded to the core 12. A suitable hardness for the cover is on the order of 30–35 durometer on the Shore A scale, and conductivity is on the order of $10^5$ ohms/sq. cm. The core and cover are sealed by nonconductive end caps 16 (see FIG. 1). The end caps 16 are rigidly attached to rotatable shafts 18, 20 for rotation with the shafts. The longitudinal axes of shafts 18, 20 are coincident with the longitudinal axis of the core 12. The shafts are supported by means (not shown) in spaced relation to an image-carrying member, for example in the form of moving web W. The resilient cover 16 contacts the web W, on the opposite side thereof from a support roller 22, under sufficient pressure to deform the cover (see FIGS. 2 and 3). The shafts 18 and 20 are driven, for example, by a stepper motor M to rotate the apparatus at an angular velocity such that the peripheral speed of the cover 14 equals the peripheral speed of the moving web W. Of course when the shafts are not driven at that angular velocity the cover slips relative to the web. Alternatively, the cover is separated from the web by relatively moving the shafts and the web support roller so that the position of the cover relative to the web is easily adjusted.

A vacuum housing 24, located in the interior of core 12, is mounted for rotation with the shafts 18, 20. The housing 24 is of U-shaped cross-section, closed by end caps 26, 28. The end cap 26, supported by shaft 18, has an opening 30 communicating with a hollow interior of such shaft. A vacuum source V, connectible to the shaft 18 through a valve V', applies a partial vacuum to the interior of housing 24 through the shaft and opening 30. The arcuate base 25 of the housing has an opening 25' communicating with a longitudinal segment of the interior wall of the core 12. The housing 24 localizes the vacuum application to such segment. Of course it is suitable for this invention to connect the vacuum source directly to the interior of the core 12. The core 12 is also connectible to a source of electrical potential such as a D.C., or biased A.C., power source 42, coupled through a switch S to a contact member 44 in sliding engagement with the interior wall of the core.

The core 12 has a plurality of passages 32 in the longitudinal segment. The passages 32 are open at the outer peripheral surface of the core and communicate with the opening 25' of the housing 24. The passages 32 are, for example, disposed such that their longitudinal axes (e.g. axis a) are at an oblique angle, at the peripheral surface of the core 12, to radii (e.g. radius r) of the core intersecting such axes respectively. The cover 14 has a plurality of passages 34 extending through the wall of the cover, located along an element of the cover overlying the longitudinal segment of the core. The passages 34 are open at the outer peripheral surface of the cover and communicate at one end with the plurality of passages 32 respectively. Similarly, the passages 34 are disposed such that their longitudinal axes (e.g. axis a') are at an oblique angle, at the peripheral surface of the cover 14, to radii (e.g. radius r') of the cover intersecting such axes respectively. Such oblique passages provide significant advantages over the foraminous transfer rollers of the prior art in that they are less likely to collect contaminants and are more readily closed on pressure deformation of the cover 14 to eliminate the surface discontinuity at the passage openings.

For operation of the transfer roller apparatus 10, a sensor 36 detects transferable images on the moving web W. Such detection may be accomplished, for example, by sensing marks associated with respective transferable images. The sensor 36, which may be of the type disclosed in U.S. Pat. No. 4,025,186 issued May 24, 1977 in the name of Hunt, Jr. et al, for example, produces signals indicative of the position of the respective images and transmits such signals to a timing and control unit 38. When a transferable image I on the moving web W is a predetermined distance from the contact area between the apparatus 10 and the web, the timing and control unit 38 provides a signal which causes the valve V' to open to apply vacuum from sources V to the housing 24. The unit 38 also provides a signal which causes the switch S to close to electrically couple the core 12 to the power source 42. Additionally, the unit 38 provides a signal which activates the motor M for driving the shafts 18, 20 to rotate the transfer roller apparatus 10 (including the housing 24), and a drive for a nip roller pair 40 to transport a receiver sheet R into contact with the rotating apparatus. The activation of the motor M and the nip roller pair is timed to place the lead edge portion of the receiver sheet R in juxtaposition with the passages 34. The receiver sheet R is thus tacked to the cover by vacuum from the housing 24. Further the activation of the motor is timed in relation to movement of the web whereby on rotation of the apparatus, the tacked receiver sheet is brought into registered contact with the image I on the web W.

With the core 12 coupled to the power source 42, a D.C. (or biased A.C.) electrical transfer potential is uniformly applied to the receiver sheet R through the conductive core and the conductive cover 14. The electrical transfer potential, applied to the receiver sheet, is chosen such that the force on the transferably marking particle image I is greater than the electrostatic force holding such marking particle image to the web W. Therefore, during contact of the receiver sheet with the image-carrying web, the image is transferred (attracted) from the web to the receiver sheet. As noted above, the cover is deformed as it is rotated through the area of contact with the web W. Such deformation closes the oblique passages 34 as the passages move through the contact area to eliminate the surface discontinuity at the passage openings, thereby insuring that the electrical transfer potential is uniformly applied to the receiver sheet, in the area where such sheet is tacked to the cover 14. The closed condition of the passages forms a continuous electrical path through the cover so that the passages do not create discontinuities in the field of the transfer potential. Control over the receiver sheet is maintained when the passages are deformed to their closed condition because the receiver sheet is sandwiched between the rotating transfer roller apparatus 10 and the moving web W in the area of contact. As the passages move away from such contact area, the passages open to reestablish vacuum tacking of the receiver sheet to the cover 14 of apparatus 10.

If the desired reproduction is to be formed from a plurality of related transferable marking particle images carried on the web W (e.g. images, which when superimposed, form a multicolor reproduction), the receiver sheet is maintained tacked to the cover 14 of apparatus 10 as the apparatus is driven through a number of rotations equal to the number of related images. While the lead edge of the sheet is vacuum tacked to the cover and the remaining portion is electrostatically tacked to the cover, such tacking is alternatively aided in the following manner. The circumferencial dimension of the cover is substantially equal to the dimension of the receiver sheet. The passages 32, 34 are then located over a longitudinal segment sufficient to enable the vacuum to also be effective to tack the trail edge of the receiver sheet to the cover. The receiver sheet is thus successively brought into contact with the web a number of times for transfer of the related images to the receiver sheet. The unit 38 controls the drive of the apparatus 10 (through stepper motor M) such that the lead edge of the receiver sheet contacts the web at the lead edge of the subsequent related images. This insures that the receiver sheet is in registered alignment with the subsequent images during transfer. The match in peripheral speeds of the apparatus and the web W insures that the transfers take place without image smearing.

After the last transfer for a complete reproduction is initiated (be it the only transfer for a reproduction made up of a single transferable image, or any subsequent transfer of a related image) unit 38 provides a signal which actuates a mechanism, such as a solenoid 48. The solenoid 48 moves a deflector gate 44 into juxtaposition with the cover 14 of the transfer roller apparatus 10 (as shown in broken lines in FIG. 2). As the lead edge of the receiver sheet contacts the gate 44, it is stripped from the cover 14 and deflected toward a transport 46 (e.g. a vacuum belt arrangement). The transport 46 captures the receiver sheet and delivers such sheet to a downstream location such as a fuser, for example, to permanently fix the transferred image (images) to the receiver sheet. After a period of time sufficient for the lead edge of the receiver sheet to be stripped from the apparatus 10, unit 38 provides a signal which deactuates the solenoid 48 to return the gate 44 to its solid line position (of FIG. 2).

The invention has been described in detail with particular reference to a preferred embodiment thereof, but it will be understood that variations and modifications can be effected within the spirit and scope of the invention.

I claim:

1. Apparatus for electrostatically transferring a transferable image from an image-carrying member to a receiver member supported on and urged by said apparatus into pressure contact with such member, said apparatus comprising:

resilient, deformable, electrically conductive means, adapted to be coupled to a source of electrical image transferring potential, said conductive means having a passage connectible to a vacuum source for vacuum tacking a receiver member to a surface of said conductive means, such passage having a longitudinal axis which, at said surface defines an oblique angle to said surface whereby said passage is closed by deformation of said means during pressure contact with the image-carrying member so that an electrical transfer potential is uniformly applied to the receiver member.

2. The invention of claim 1 wherein said conductive means is a roller mounted for rolling pressure contact with the image-carrying member.

3. A roller for electrostatically transferring a transferable image onto a receiver member, said roller comprising:

an electrically conductive, hollow cylindrical core having a vacuum passage opening to the core surface, said core being connectible to a source of vacuum and a source of electrical transfer potential; and a resilient, deformable, electrically conductive cover on said core, said cover having a vacuum passage open at the outer peripheral surface of said cover and in communication with the passage in said core for tacking a receiver member to the surface of said cover, such passage in said cover having a longitudinal axis which, at the peripheral surface of said cover, defines an oblique angle to a radius of said core intersecting such axis.

4. For use in apparatus for transferring a transferable image from an image-carrying member to a receiver sheet, a transfer roller for rotatably supporting a receiver sheet and for applying an electrical transfer potential uniformly to such supported receiver sheet in a pressure nip between said roller and an image-carrying member, said roller comprising:

an electrically conductive, hollow cylindrical core having a vacuum passage opening to the core surface, and adapted to be coupled to a source of vacuum and a source of electrical transfer potential; and a resilient, deformable, electrically conductive cover on said core, said cover having a plurality of vacuum passages open at the outer peripheral surface of said cover and in communication with said core passage, said cover passages having longitudinal axes which, at the peripheral surface of said cover, define an oblique angle to radii of said core intersecting such axes;

whereby vacuum applied to said core passage is effective through said cover passages to tack a receiver sheet to the peripheral surface of said cover, and the cover passages, in the pressure nip are closed by deformation of said cover to eliminate the discontinuity at the passage openings so that an electrical transfer potential is uniformly applied to the supported receiver sheet.

5. Transfer roller apparatus for applying an electrical transfer potential uniformly to a receiver sheet while under pressure between the roller and an image-carrying member for transferring a transferable image from the image-carrying member to the receiver sheet, said transfer roller apparatus comprising:

an electrically conductive, hollow cylindrical core having at least one vacuum passage through the core surface;

means for connecting a source of electrical image transferring potential to said core;

a vacuum housing mounted within said core for rotation therewith, said housing having an opening in communication with said vacuum passage;

means for connecting a source of vacuum to said housing; and a resilient, deformable, electrically conductive cover on the peripheral surface of said core, said cover having at least one vacuum passage open at the outer peripheral surface of said cover and in communication with said core passage, said cover passage having a longitudinal axis which at the peripheral surface of said cover defines an oblique angle to a radius of said core intersecting such axis;

whereby vacuum applied to said core passage is effective through said cover passage to tack a receiver sheet to the peripheral surface of said cover for rotation therewith, and the cover passage, in the area of pressure contact between the receiver member and the image-carrying member, is closed by deformation of said cover to eliminate the discontinuity at the passage opening so that the electrical transfer potential is uniformly applied to the receiver member.

6. The invention of claim 5 wherein said cylindrical core has a plurality of vacuum passages through the core surface along a longitudinal segment of said core, and said cover has a plurality of vacuum passages located along an element of said cover overlying such longitudinal segment, said plurality of core passages being associated with said plurality of cover passages respectively.

* * * * *